US007152246B2

(12) United States Patent
Infante

(10) Patent No.: US 7,152,246 B2
(45) Date of Patent: Dec. 26, 2006

(54) QUICK ATTACH/RELEASE METHODS AND APPARATUS FOR PERSONAL APPAREL AND ACCESSORIES

(76) Inventor: Michael Infante, 49 N. Hillside Ave., Chatham, NJ (US) 07928

( * ) Notice: Subject to any disclaimer, the term of this patent is extended or adjusted under 35 U.S.C. 154(b) by 244 days.

(21) Appl. No.: 10/831,463

(22) Filed: Apr. 23, 2004

(65) Prior Publication Data

US 2005/0071906 A1 Apr. 7, 2005

Related U.S. Application Data

(60) Provisional application No. 60/509,094, filed on Oct. 6, 2003.

(51) Int. Cl.
*A41D 13/00* (2006.01)

(52) U.S. Cl. ..... 2/22

(58) Field of Classification Search ..... 2/16, 2/24, 22, 455, 242, 267, 62, 911; 128/878, 128/881, 882; 602/20, 23, 25–27, 62, 63
See application file for complete search history.

(56) References Cited

U.S. PATENT DOCUMENTS 4,868,926 A * 9/1989 Lowson ..... 2/22
5,031,904 A * 7/1991 Solloway ..... 482/111
5,806,092 A * 9/1998 Shikatani ..... 2/22
5,916,183 A * 6/1999 Reid ..... 601/134
6,109,267 A * 8/2000 Shaw et al. ..... 128/882
6,272,682 B1 * 8/2001 Fullum ..... 2/22
6,945,944 B1 * 9/2005 Kuiper et al. ..... 602/13

* cited by examiner

*Primary Examiner*—Tejash Patel
(74) *Attorney, Agent, or Firm*—Wolf, Greenfield & Sacks, P.C.

(57) ABSTRACT

Methods and apparatus for facilitating quick and convenient putting-on and taking-off of various personal apparel and accessories, including a variety of protection and/or sporting equipment. One example includes a goalie pad including a protective portion configured to protect at least some portion of a leg of a person, and an adjustable portion coupled to the protective portion and including at least one adjustment mechanism configured to facilitate an adjustable fitting of the goalie pad to the person. The goalie pad further includes at least one attach/release mechanism, coupled to the protective portion and the adjustable portion, to facilitate at least one of a putting-on and a taking-off of the goalie pad to and from the person. In various aspects, putting-on and taking-off of the goalie pad may be performed without making any significant adjustments to the adjustment mechanism(s), and/or may be performed by a single act.

10 Claims, 6 Drawing Sheets

QUICK ATTACH/RELEASE METHODS AND APPARATUS FOR PERSONAL APPAREL AND ACCESSORIES

CROSS-REFERENCE TO RELATED APPLICATION

This application claims the benefit, under 35 U.S.C. §119(e), of U.S. Provisional Application Ser. No. 60/509,094, filed Oct. 6, 2003, entitled "Quick Attach/Release Methods and Apparatus for Personal Apparel and Accessories," which application is hereby incorporated herein by reference.

FIELD OF THE INVENTION

The present invention relates to methods and apparatus for facilitating quick and convenient putting-on and taking-off of various personal apparel and accessories, including a variety of protection and/or sporting equipment.

BACKGROUND

Many types of personal apparel and accessories, including various types of protective wear and items associated with sporting activities, often involve a strap and buckle system to allow adjustable fitting of the item to a person. Some common examples of such a strap and buckle system are given by an ordinary waist belt (e.g., for men's pants) and many types of watch bands.

FIG. 1 illustrates an example of such a strap and buckle system used in a conventional ice hockey goalie pad 10. As shown in FIG. 1, the conventional goalie pad 10 typically is equipped with a number of strap/buckle pairs; in the particular example of FIG. 1, the strap/buckle pairs 20, 22, 24, 26 and 28 are arranged to secure the pad to the leg of the goalie, whereas the strap/buckle pair 30 is arranged to secure the pad to the toe section of an ice skate worn by the goalie. As should be readily appreciated, each of the strap/buckle pairs is adjustable (via a number of holes in the strap with which the buckle may be secured) based on the size of the goalie's leg and the goalie's comfort needs.

Although such an arrangement typically is effective for adequately securing the goalie pad to the goalie's leg, one disadvantage of the conventional arrangement shown in FIG. 1 is that the goalie pad may not be easily and quickly put on or removed. Specifically, each time the goalie desires to put on or remove the pad, the goalie must adjust and buckle or undo each of the strap/buckle pairs. Moreover, the particular adjustments made by the goalie during one wearing of the goalie pad are lost when the goalie needs to remove the pad; hence, the buckle/strap pairs need to be readjusted with each wearing of the pad.

SUMMARY

In view of the foregoing, the present invention is directed generally to methods and apparatus for facilitating quick and convenient putting-on and taking-off of various personal apparel and accessories, including a variety of protection and/or sporting equipment. Although the specific example of a conventional goalie pad was discussed above to demonstrate some disadvantages of common prior arrangements for putting-on and taking-off of various personal apparel and accessories, it should be appreciated that many types of personal apparel and accessories with such conventional arrangements suffer from similar drawbacks and disadvantages. Hence, a number of concepts disclosed herein in connection with the present invention have general applicability to a wide variety of personal apparel and accessories for a number of different activities and uses.

For example, one embodiment of the present invention is directed to an apparatus, comprising at least one personal accessory to be worn by or coupled to a person and at least one adjustment mechanism coupled to the personal accessory and configured to facilitate an adjustable fitting of the personal accessory to the person. The apparatus of this embodiment further comprises at least one attach/release mechanism, coupled to the personal accessory and the adjustment mechanism, to facilitate at least one of a putting-on and a taking-off of the personal accessory.

In one aspect of this embodiment, the at least one attach/release mechanism is configured such that only a single act is required to effect at least one of the putting-on and the taking-off of the personal accessory. In other aspects of this embodiment, the personal accessory may be an ice hockey goalie pad, and the attach/release mechanism may include a zipper arrangement or other coupling mechanism that facilitates quick and easy attachment/release of the personal accessory, in some instances without requiring any adjustments of the adjustment mechanism.

Another embodiment of the invention is directed to an ice hockey goalie pad, comprising a protective portion configured to protect at least some portion of a leg of a person, and an adjustable portion coupled to the protective portion and including at least one adjustment mechanism configured to facilitate an adjustable fitting of the goalie pad to the person. The goalie pad further comprises at least one attach/release mechanism, coupled to the protective portion and the adjustable portion, to facilitate at least one of a putting-on and a taking-off of the goalie pad to and from the person.

Another embodiment of the invention is directed to a method of putting-on or taking-off an ice hockey goalie pad including at least one adjustment mechanism coupled to the goalie pad and configured to facilitate an adjustable fitting of the goalie pad to a person. The method of this embodiment comprises performing at least one of the putting-on and the taking-off of the goalie pad without making any significant adjustments to the at least one adjustment mechanism.

Another embodiment of the invention is directed to a method of putting-one or taking-off an ice hockey goalie pad including at least one adjustment mechanism coupled to the goalie pad and configured to facilitate an adjustable fitting of the goalie pad to a person. The method of this embodiment comprises performing only a single act to effect at least one of the putting-on and the taking-off of the goalie pad.

It should be appreciated that all combinations of various concepts discussed above and in greater detail below are contemplated as being part of the inventive subject matter disclosed herein. In particular, all combinations of claimed subject matter appearing at the end of this disclosure are contemplated as being part of the inventive subject matter.

DETAILED DESCRIPTION

Applicants have recognized and appreciated that, as discussed above, some types of personal apparel and accessories, both adjustably fitting and non-adjustably fitting, would benefit from employing an attach/release mechanism for facilitating quick and convenient putting-on and removal of the apparel/accessory(ies). Accordingly, various embodiments of the present invention are directed to methods and apparatus for accomplishing these goals.

Following below is a more detailed description of various concepts related to, and embodiments of, methods and apparatus according to the present invention. It should be appreciated that various aspects of the invention as discussed above and outlined further below may be implemented in any of numerous ways, as the invention is not limited to any particular manner of implementation. Examples of specific implementations are provided herein primarily for illustrative purposes.

Figure 1:
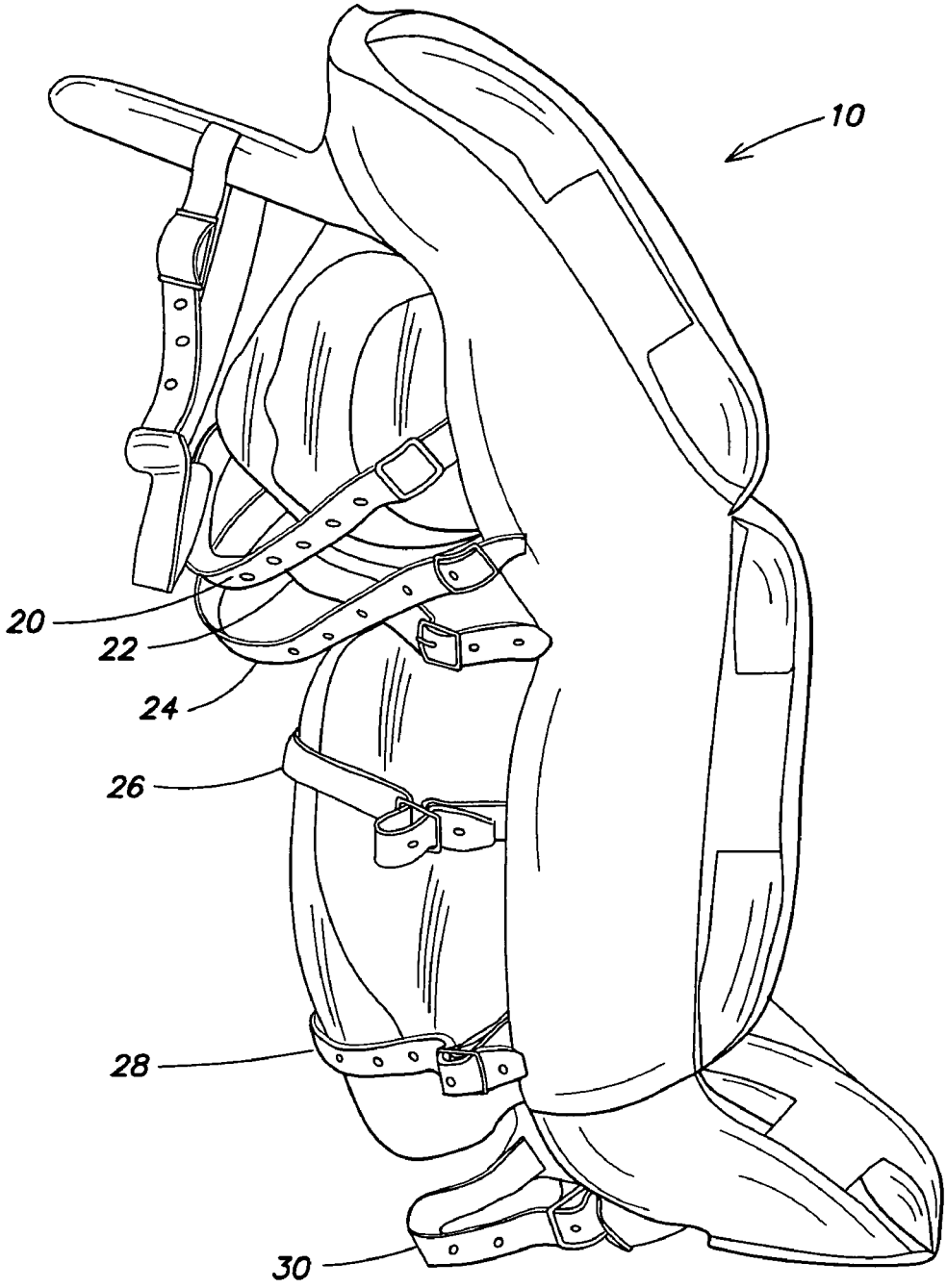
FIG. 1 is a diagram illustrating one example of a conventional goalie pad employing a common strap and buckle system.
Figure 2:
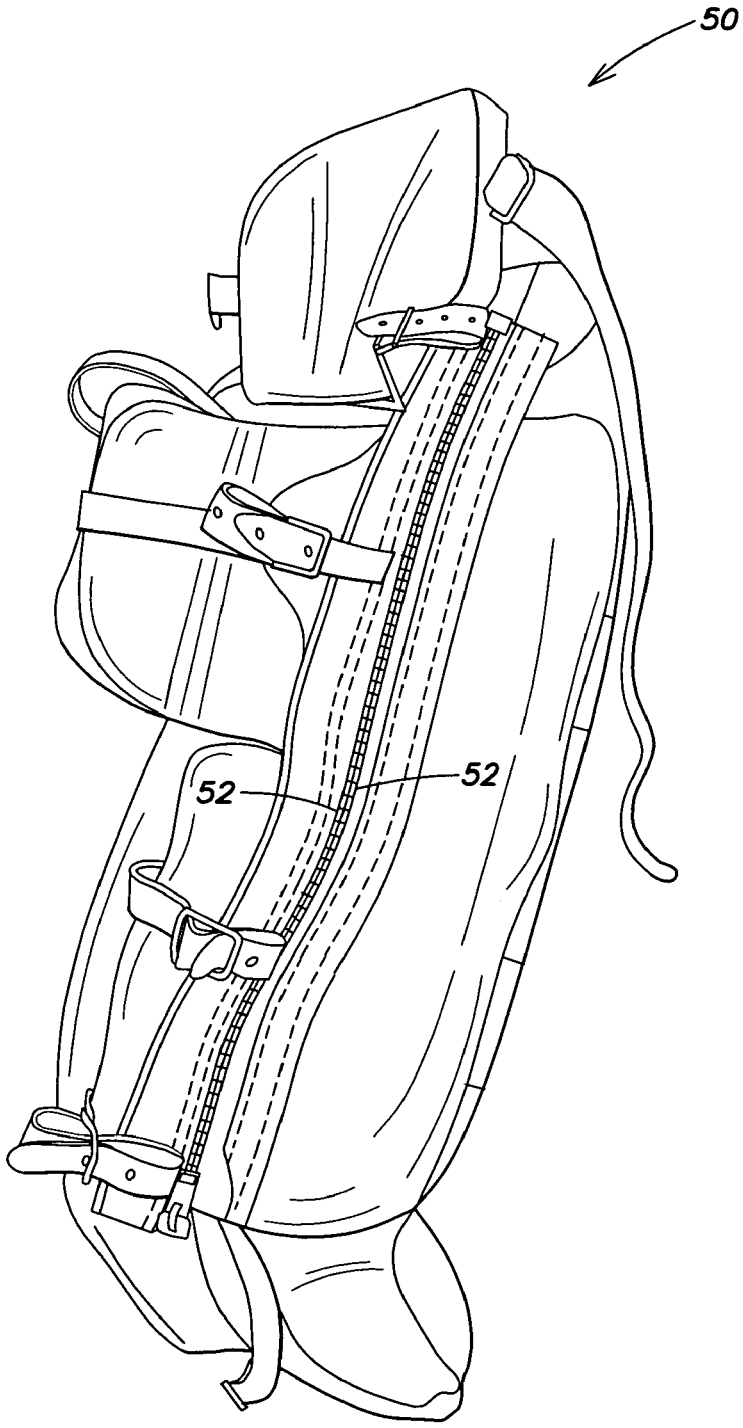
FIG. 2 is a diagram illustrating an example of a goalie pad employing an attach/release mechanism according to one embodiment of the present invention for facilitating quick and convenient putting-on and removal of the goalie pad.

FIG. 2 illustrates an apparatus according to one embodiment of the invention comprising a personal accessory, one or more adjustment mechanisms, and one or more attach/release mechanisms to facilitate quick and convenient putting-on and removal of the personal accessory. Specifically, FIG. 2 shows an ice hockey goalie pad 50, similar to that shown in FIG. 1, with at least one significant difference in that at least one attach/release mechanism 52 is included. In one aspect of this embodiment, the attach/release mechanism 52 may be a zipper mechanism including first and second complimentary mating portions, in which a first mating portion of the zipper mechanism is coupled to the buckles of the strap/buckle pairs 20, 22, 24, 26 and 28, and a second mating portion of the zipper mechanism is coupled directly to some portion of the goalie pad.

Figure 3:
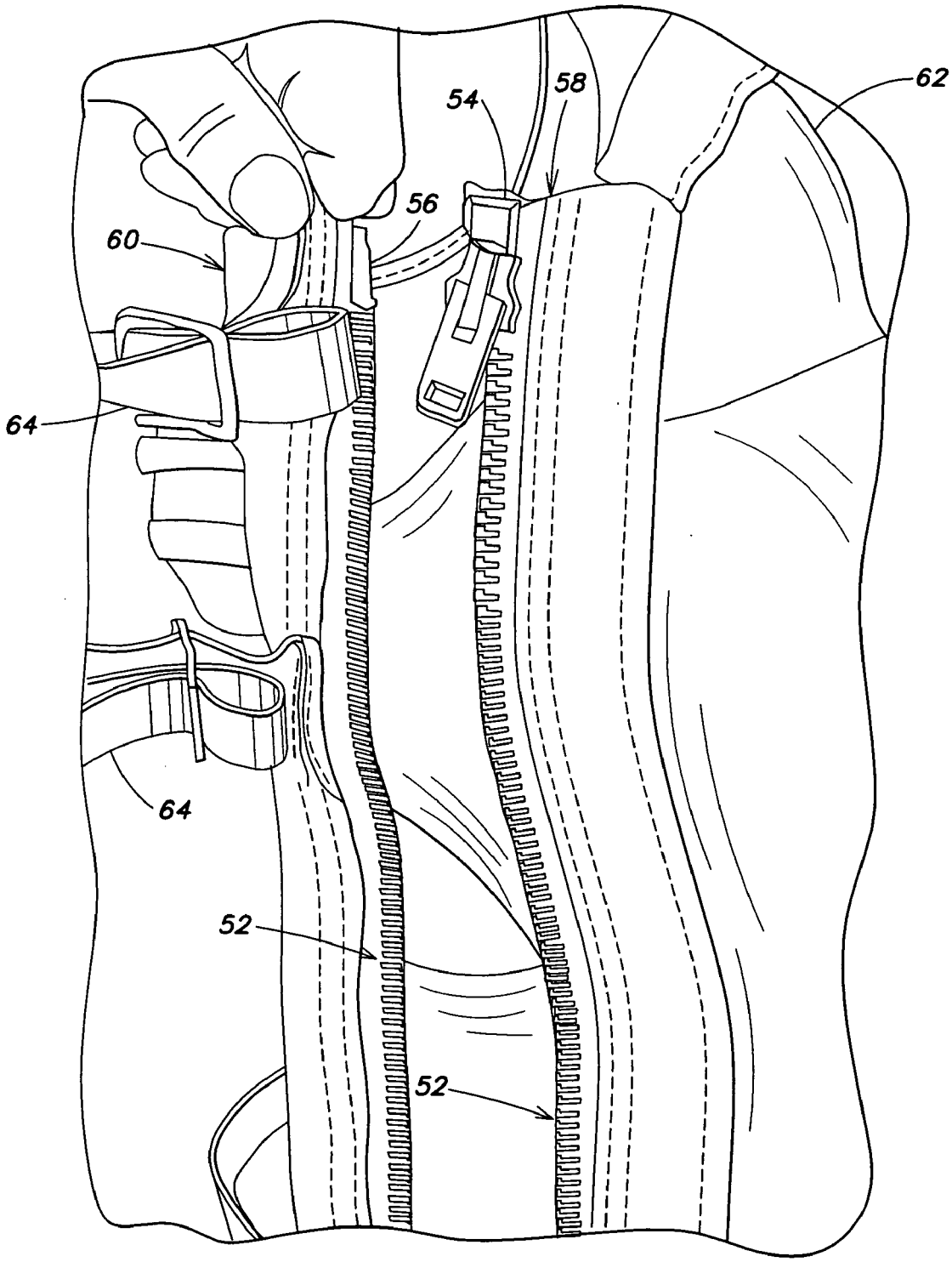
FIG. 3 is a diagram showing a close-up view of the attach/release mechanism of the goalie pad of FIG. 2, according to one embodiment of the invention.

For example, FIG. 3 is a diagram showing a close-up view of the attach/release mechanism of the goalie pad of FIG. 2. As illustrated in FIG. 3, the attach/release mechanism 52 according to this embodiment is a zipper mechanism including a first mating portion 54 attached to a protective (i.e., padded) body portion 62 of the goalie pad 50 via a first coupling mechanism 58. The attach/release mechanism 52 also includes a second mating portion 56 attached to an adjustable portion 64 of the goalie pad 50 via a second coupling mechanism 60.

For purposes of this embodiment, the adjustable portion 64 indicated in FIG. 3 refers generally to one or more of the collection of strap/buckle pairs 20, 22, 24, 26 and 28 shown for example in FIGS. 1 and 2. It should be appreciated that, according to different aspects of this embodiment, the second mating portion 56 may be coupled to either one or more straps, one or more buckles, or various combinations of straps and buckles of the adjustable portion 64.

It should also be appreciated that, in other embodiments, an adjustable portion of a goalie pad may be implemented in ways other than by employing the common strap/buckle pairs discussed above, and that the invention is not limited in this respect. In general, the adjustable portion of the goalie pad may include one or more components arranged to facilitate some type of an adjustment of the goalie pad with respect to a leg of a person wearing the goalie pad. For example, in other embodiments, the adjustable portion may be implemented using one or more toothed clamping mechanisms to constrain a band of material in a particular position, a multiple loop buckle system, a side-squeeze buckle system, a slip-ring buckle system, complimentary pairs of Velcro strips, laces, or other coupling mechanisms including, but not limited to, magnetic components, snaps, hooks, and the like.

In one aspect of the embodiment illustrated in FIG. 3, one or both of the first coupling mechanism 58 and the second coupling mechanism 60 may be implemented as a stitched band of some material (e.g., leather or other natural or synthetic fabric) that couples a portion of the attach/release mechanism 52 to another portion of the goalie pad 50. However, it should be appreciated that the invention is not limited in this respect, as other types of coupling mechanisms may be employed (e.g., some type of adhesive or other boding agent in place of or in addition to stitching).

Figure 4:
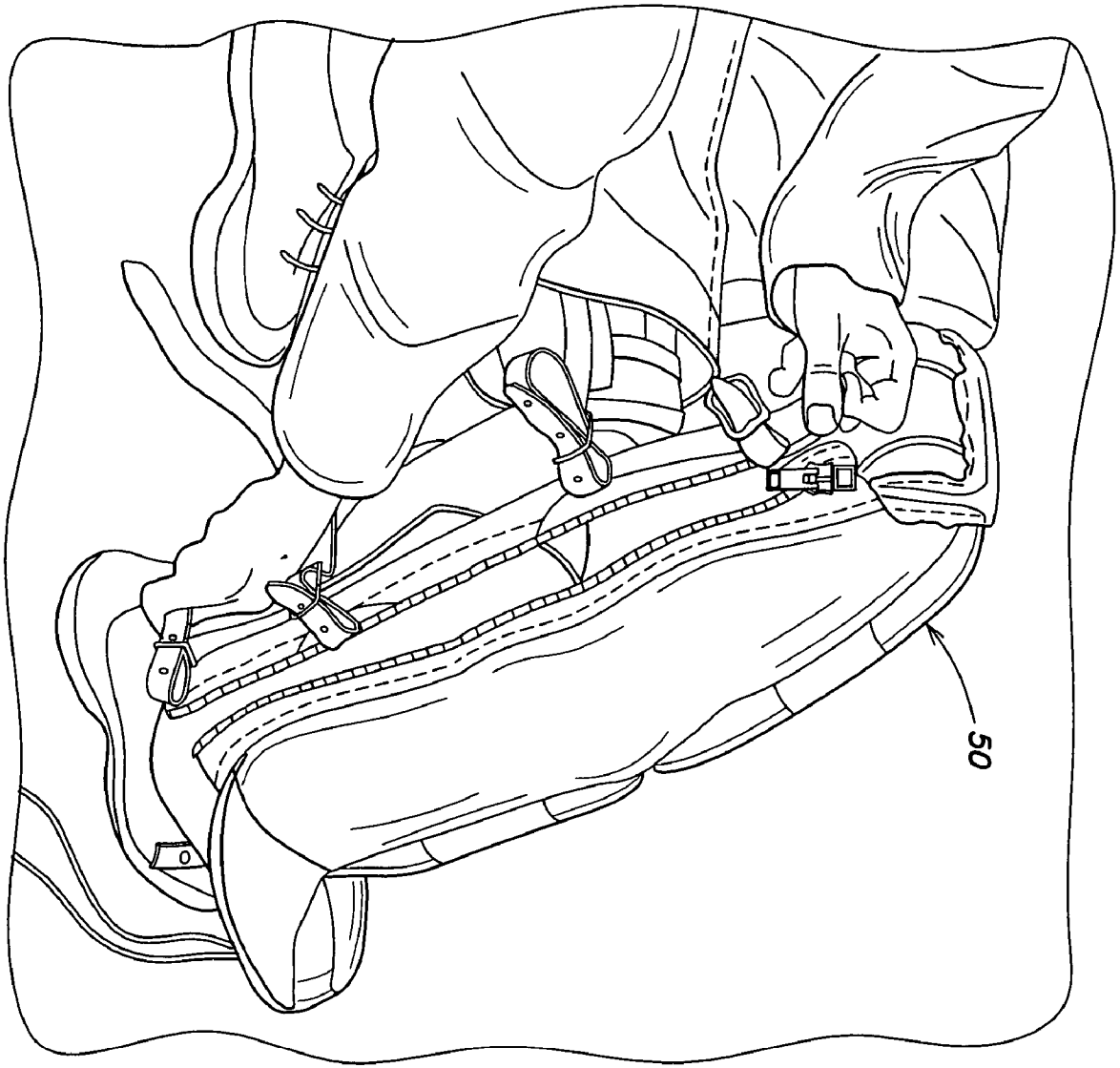
FIG. 4 is a diagram showing the goalie pad of FIG. 2 in an "open" or released position around the leg of a person, according to one embodiment of the invention.
Figure 5:
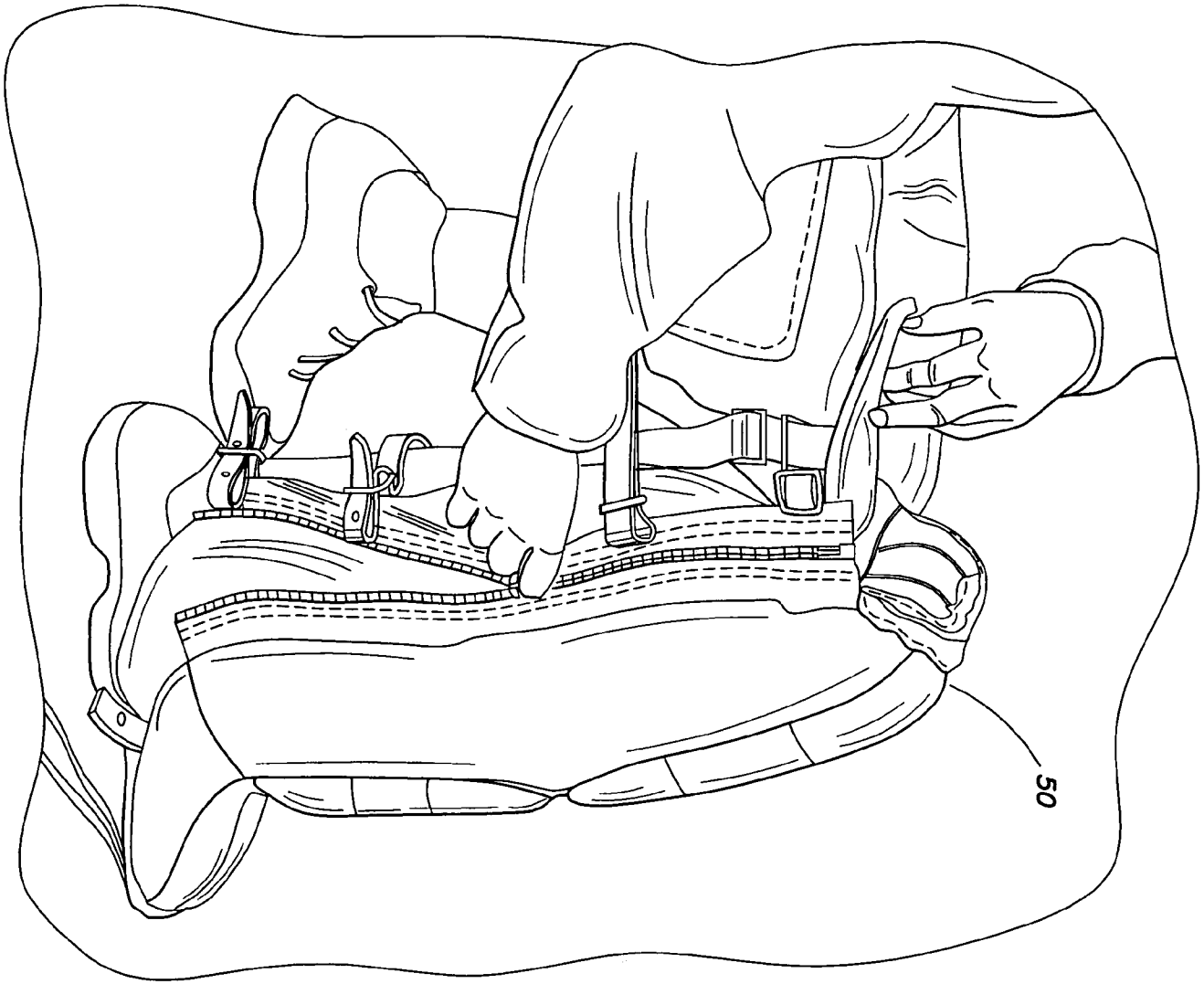
FIG. 5 is a diagram showing the goalie pad of FIG. 2 in an intermediate position as the goalie pad is either being attached to or released from the leg of a person, according to one embodiment of the invention.
Figure 6:
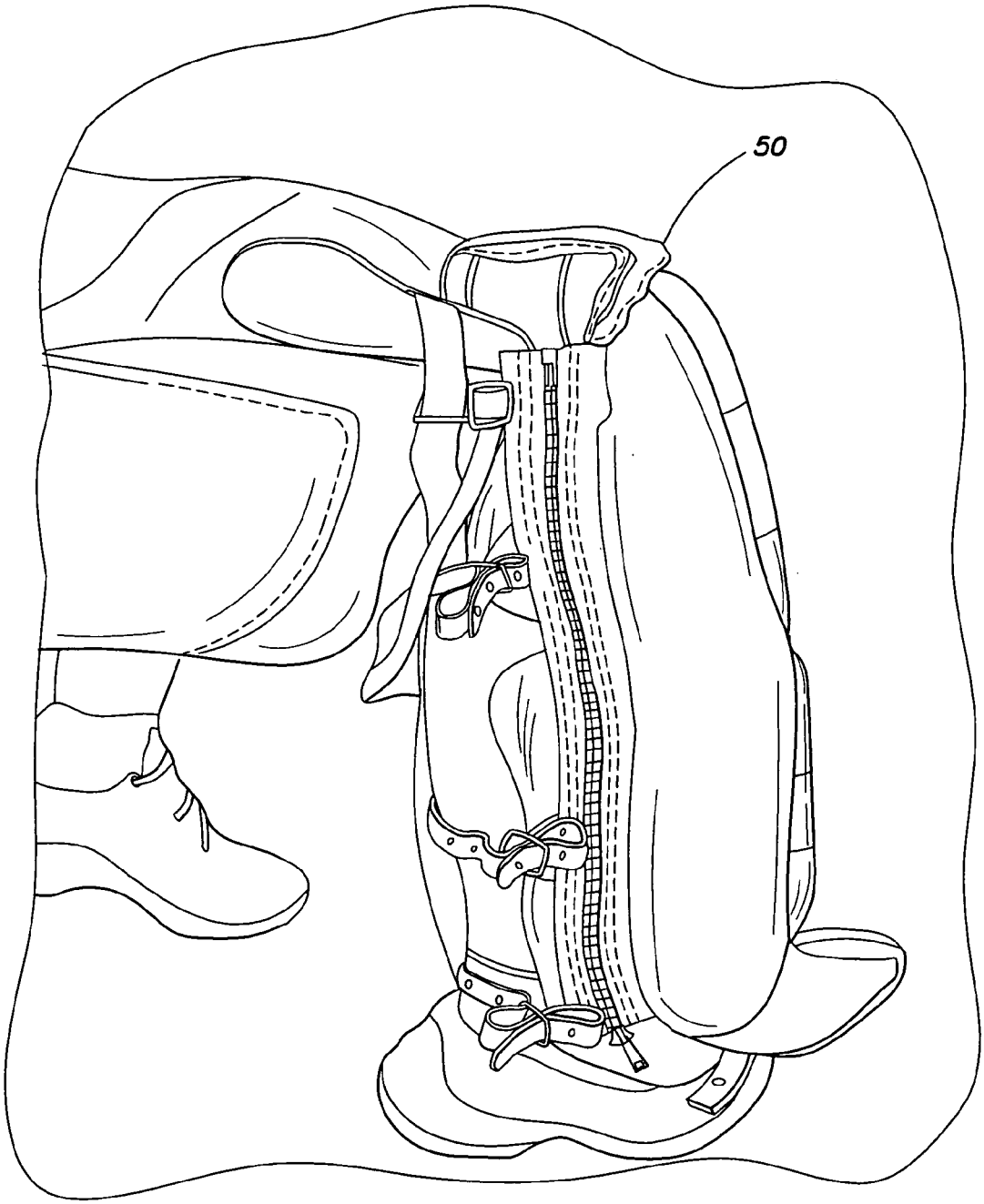
FIG. 6 is a diagram showing the goalie pad of FIG. 2 in a "closed" or attached position around the leg of a person, according to one embodiment of the invention.

FIGS. 4–6 are drawings illustrating three different "states" of the goalie pad 50 as it is either being attached to or released from a leg of a person. In particular, FIG. 4 shows the goalie pad 50 in an "open" or released position around the leg of a person, FIG. 5 shows the goalie pad in an intermediate position as the goalie pad is either being attached to or released from the leg of a person, and FIG. 6 shows the goalie pad in a "closed" or attached position around the leg of a person.

Based on the illustrations of FIGS. 4–6, it should be readily appreciated that, according to one embodiment of the present invention, the attach/release mechanism 52 facilitates at least a quick removal of the goalie pad 50 from the leg of a person with essentially a single act and without significantly disturbing the adjustments of the adjustable portion of the goalie pad (e.g., the strap/buckle pairs). For example, once the goalie pad is in the "closed" position as shown in FIG. 6 and particular adjustments of the adjustable portion have been made, the goalie pad may be conveniently released from the leg of the person by a single operation as shown in FIG. 5 (i.e., operating or "un-doing" the zipper mechanism) until the goalie pad is in the "open" position shown in FIG. 4. In another aspect of this embodiment, the reverse is possible; namely, the person may put on the goalie pad while essentially maintaining prior adjustments of the adjustment portion by operating the attach/release mechanism (e.g., mating the complimentary portions of the zipper mechanism by operating or "zipping up" the zipper mechanism) without significantly disturbing the adjustable portion.

It should be appreciated that the foregoing embodiments of a goalie pad employing a zipper mechanism provide only some illustrative examples of various concepts according to the present invention, and that the invention is not limited to these embodiments. More generally, various adjustable or essentially non-adjustable personal accessories, including protective apparel (e.g., a bullet proof vest, various firefighting gear) and a wide variety of sporting apparel/equipment (e.g., baseball or softball catcher's shin guard, field hockey shin pad, parachute harness, rock climbing harness, ice skates, ski or snow board boots, etc.) may be equipped with various types of attach/release mechanisms to facilitate quick and convenient putting-on and taking-off of the apparel/accessory(ies) pursuant to the present invention. Examples of different attach/release mechanisms that may be employed in different embodiments of the invention include, but are not limited to, zipper mechanisms, magnetic coupling mechanisms, Velcro coupling mechanisms, snap or button mechanisms, hook mechanisms, and the like.

In some implementations of a personal accessory or apparel item according to the present invention, the combination of one or more quick attach/release mechanisms and one or more adjustment mechanisms particularly facilitates conveniently putting-on or taking off the accessory/apparel item while maintaining an adjustment or fit of the accessory/apparel to the person (e.g., for comfort, safety, appearance, etc.).

Having thus described at least one illustrative embodiment of the invention, various alterations, modifications, and improvements will readily occur to those skilled in the art. Such alterations, modifications, and improvements are intended to be within the spirit and scope of the invention. Accordingly, the foregoing description is by way of example only, and is not intended as limiting.

What is claimed is:

1. An ice hockey goalie pad for protecting the leg from force of impact, comprising:

a protective portion of the ice hockey goalie pad configured to protect at least some portion of a leg of a person, the protective portion further configured so as not to obstruct at least a bottom portion of a foot of the person to facilitate wearing of foot apparel;

an adjustable portion coupled to the protective portion, the adjustable portion including at least one adjustment mechanism configured to facilitate an adjustable fitting of the goalie pad to the leg of a person; and at least one attach/release mechanism, coupled to the protective portion and the adjustable portion, to facilitate at least one of a putting-on and a taking-off of the goalie pad to and from the person wherein the at least one attach/release mechanism is configured to facilitate at least one of the putting-on and the taking-off the goalie pad without disturbing a prior adjustment of the adjustable portion; and wherein the at least one attach/release mechanism includes at least one zipper mechanism.

2. The goalie pad of claim 1, wherein the at least one attach/release mechanism is configured such that only a single zipper act is required to effect at least one of the putting-on and the taking-off of the goalie pad.

3. The goalie pad of claim 1, wherein the at least one attach/release mechanism includes first and second portions, and wherein:

the first portion of the attach/release mechanism is coupled directly to the protective portion of the goalie pad; and the second portion of the attach/release mechanism is coupled to the adjustable portion of the goalie pad.

4. The goalie pad of claim 1, wherein the at least one adjustment mechanism includes at least one pair of components arranged to facilitate the adjustable fitting of the goalie pad to the person.

5. The goalie pad of claim 4, wherein the at least one adjustment mechanism includes a plurality of strap and buckle pairs.

6. The goalie pad of claim 1, wherein the at least one zipper mechanism includes first and second complimentary mating portions;

the first mating portion of the at least one zipper mechanism is coupled directly to the protective portion of the goalie pad; and the second mating portion of the at least one zipper mechanism is coupled to the adjustable portion of the goalie pad.

7. The goalie pad of claim 1, wherein the at least one adjustment mechanism includes a plurality of strap and buckle pairs.

8. An ice hockey goalie pad for protecting the leg from force of impact, comprising:

a protective portion of the ice hockey goalie pad configured to protect at least some portion of a leg of a person;

an adjustable portion coupled to the protective portion, the adjustable portion including at least one adjustment mechanism configured to facilitate an adjustable fitting of the goalie pad to the person; and at least one attach/release mechanism, coupled to the protective portion and the adjustable portion, to facilitate at least one of a putting-on and a taking-off of the goalie pad to and from the leg of the person without disturbing a prior adjustment of the adjustable portion, wherein:

the at least one attach/release mechanism includes at least one zipper mechanism;

the at least one adjustment mechanism includes a plurality of strap and buckle pairs; and the plurality of strap and buckle pairs includes:

a plurality of straps having a plurality of adjustment holes; and a corresponding plurality of buckles;

the at least one zipper mechanism includes first and second complimentary mating portions;

the first mating portion of the at least one zipper mechanism is coupled directly to the protective portion of the goalie pad; and the second mating portion of the at least one zipper mechanism is coupled to one of the plurality of straps and the plurality of buckles.

9. In connection with an ice hockey goalie pad for protecting at least some portion of a leg of a person from force of impact, the ice hockey goalie pad including at least one adjustment mechanism and a zipper coupled to the goalie pad and configured to facilitate an adjustable fitting of the goalie pad to the leg of a person, a method of putting-on or taking-off the goalie pad, comprising;

A) performing at least one of the putting-on and the taking-off of the goalie pad via a zipping action without making any adjustments to the at least one adjustment mechanism.

10. The method of claim 9, wherein the act A) includes an act of performing only a single zipping act to effect at least one of the putting-on and the taking-off of the goalie pad.

* * * * *